US007335136B2

(12) United States Patent
Brodbeck

(10) Patent No.: US 7,335,136 B2
(45) Date of Patent: Feb. 26, 2008

(54) TRAINING DEVICE FOR SWIMMERS

(75) Inventor: Ralph R. Brodbeck, Cincinnati, OH (US)

(73) Assignee: Philosophics, Inc., Cincinnati, OH (US)

( * ) Notice: Subject to any disclaimer, the term of this patent is extended or adjusted under 35 U.S.C. 154(b) by 372 days.

(21) Appl. No.: 11/185,453

(22) Filed: Jul. 20, 2005

(65) Prior Publication Data

US 2007/0021275 A1 Jan. 25, 2007

(51) Int. Cl.
*A63B 31/00* (2006.01)

(52) U.S. Cl. ..... 482/55; 482/87; 434/254

(58) Field of Classification Search ..... 482/55, 482/83–90, 148; 434/254; 441/55, 133, 441/136; 4/487, 496, 497, 505
See application file for complete search history.

(56) References Cited

U.S. PATENT DOCUMENTS 1,890,696 A * 12/1932 Rosenhahn ..... 482/90
3,022,072 A * 2/1962 Zinnow ..... 482/90
3,304,089 A * 2/1967 Smith ..... 473/440
3,772,718 A * 11/1973 Williams ..... 441/133
5,485,993 A * 1/1996 Lipsett ..... 473/448
5,888,152 A * 3/1999 Rogers et al. ..... 473/440
6,331,129 B1 * 12/2001 Earley ..... 441/133
2005/0255433 A1 * 11/2005 Ryland ..... 434/254

* cited by examiner

*Primary Examiner*—Lori Amerson
*Assistant Examiner*—Tam Nguyen
(74) *Attorney, Agent, or Firm*—Wood, Herron & Evans

(57) ABSTRACT

A training device for use in a pool having a lane guide. The training device comprises a base member shaped to cooperate with at least a portion of the lane guide, an elongated member adapted to pivot relative to the base member, and a resilient member coupling the elongated member to the base member in an initial position. The resilient member is adapted to return the elongated member to the initial position when the elongated member deviates therefrom.

16 Claims, 6 Drawing Sheets

TRAINING DEVICE FOR SWIMMERS

FIELD OF THE INVENTION

The present invention relates generally to athletic training devices, and more particularly, to a training device for swimmers.

BACKGROUND OF THE INVENTION

Competitive swimming has been an extremely popular sport for some time now. Many different levels of competition exist for children and adults of all ages. As with most other sports, an individual is typically able to improve his or her performance by developing proper technique through coaching and practice. Proper technique not only involves the mechanics associated with a particular swimming stroke, but also how to effectively incorporate the other aspects of a competitive race.

For example, coaches must be able to teach swimmers how far to dive into the water off a starting block. Entering the water too close to the starting block likely indicates a poor starting technique and typically results in less forward momentum. Coaches must also be able to teach swimmers when to surface above the water after the starting dive. For example, after a successful starting dive, a swimmer typically remains submerged for a brief period of time while performing a flutter kick or butterfly kick and traveling forward. Eventually the swimmer loses some of the forward momentum from the dive such that it becomes more effective for him or her to begin the particular swimming stroke. Knowing when to surface and begin the stroke can lead to a faster lap time. The same can be said with respect to flip-turns or any other maneuver that requires a swimmer to remain submerged for a particular distance.

While a variety of training equipment for swimmers exists in the marketplace, most of the devices are directed solely towards improving stroke technique. For example, pull-buoys, hand paddles, and kickboards are all common pieces of training equipment that do not effectively address the aspects of competitive swimming discussed above. Coaches have also used visualization equipment such as videotape to review starting dives, flip-turns, and the like. Although visualization equipment may help swimmers develop proper starting and turning techniques, many coaches find that such equipment is expensive and prone to yielding marginal improvement. Moreover, many competitive swimming clubs or organizations practice in a pool that is also used for recreational or other purposes. Any visualization equipment used by the clubs must typically be set-up before practice and taken down afterwards, a burden that many coaches prefer not to deal with on a day-to-day basis.

Therefore, there is a need for a training device for swimmers that is easy to use, inexpensive, and most importantly, effective.

SUMMARY OF THE INVENTION

The present invention provides a training device for use in a pool having a lane guide. In general, the training device comprises a base member shaped to cooperate with at least a portion of the lane guide, an elongated member adapted to pivot relative to the base member, and a resilient member coupling the elongated member to the base member in an initial position. The resilient member is adapted to return the elongated member to the initial position whenever it deviates therefrom. To this end, the training device may be secured to the lane guide at a particular location and used as a target to let swimmers know how far they should jump from the starting blocks or whether they have surfaced at the appropriate time after the starting time. Should a swimmer contact the elongated member, the elongated member will deflect or pivot relative to the base member in order to prevent injury and allow the swimmer to continue traveling forward.

In a further aspect of the present invention, end portions of the resilient member extend through first and second apertures on the base member. The training device may then be secured to the lane guide by wrapping the end portions of the resilient member around the lane guide. Such an arrangement enables the training device to be quickly and easily set-up in a pool before or during swim practice. The device may also be quickly removed from the lane guide and easily stored or transported.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
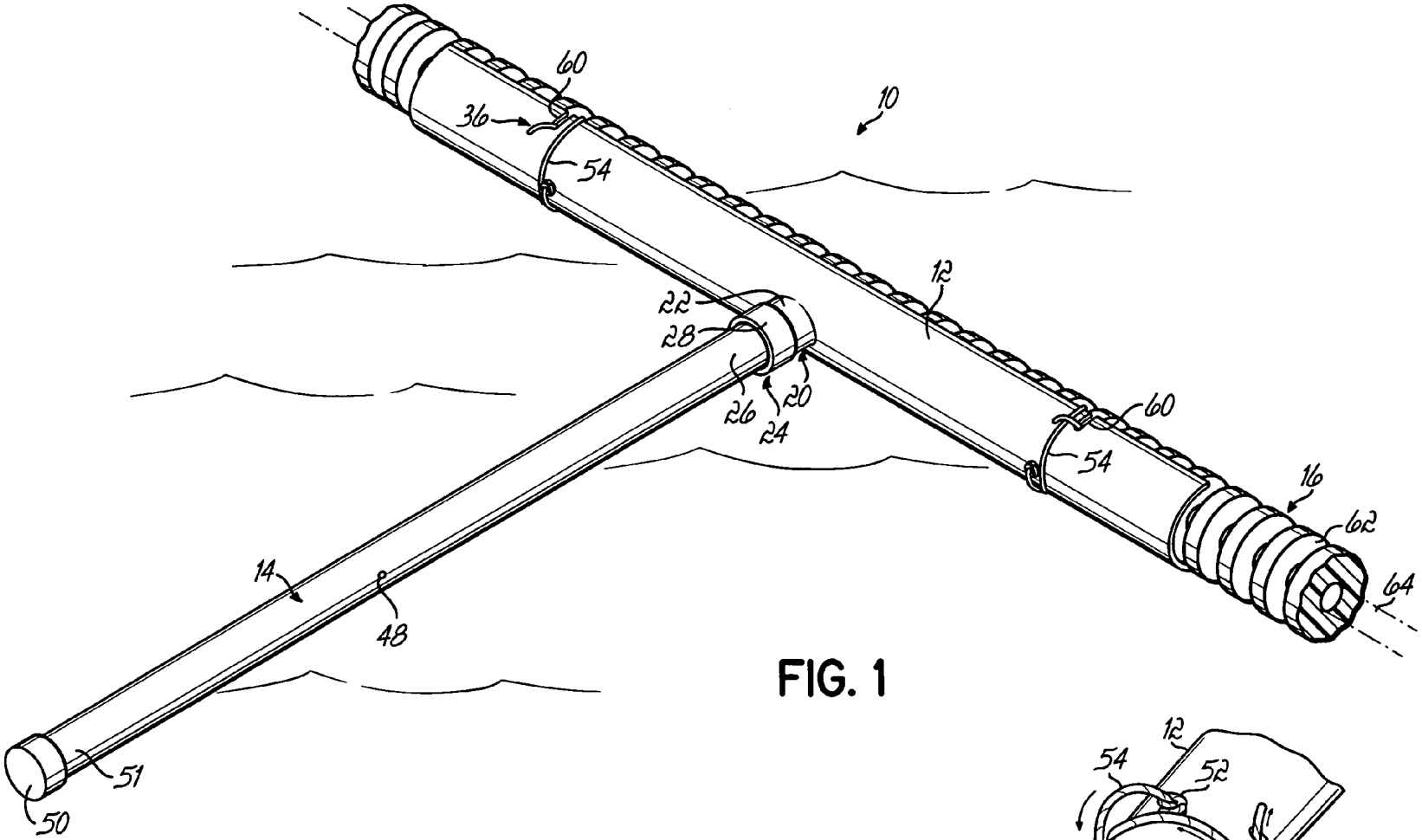
FIG. 1 is a perspective view showing a training device according to an embodiment of the present invention.
Figure 2:
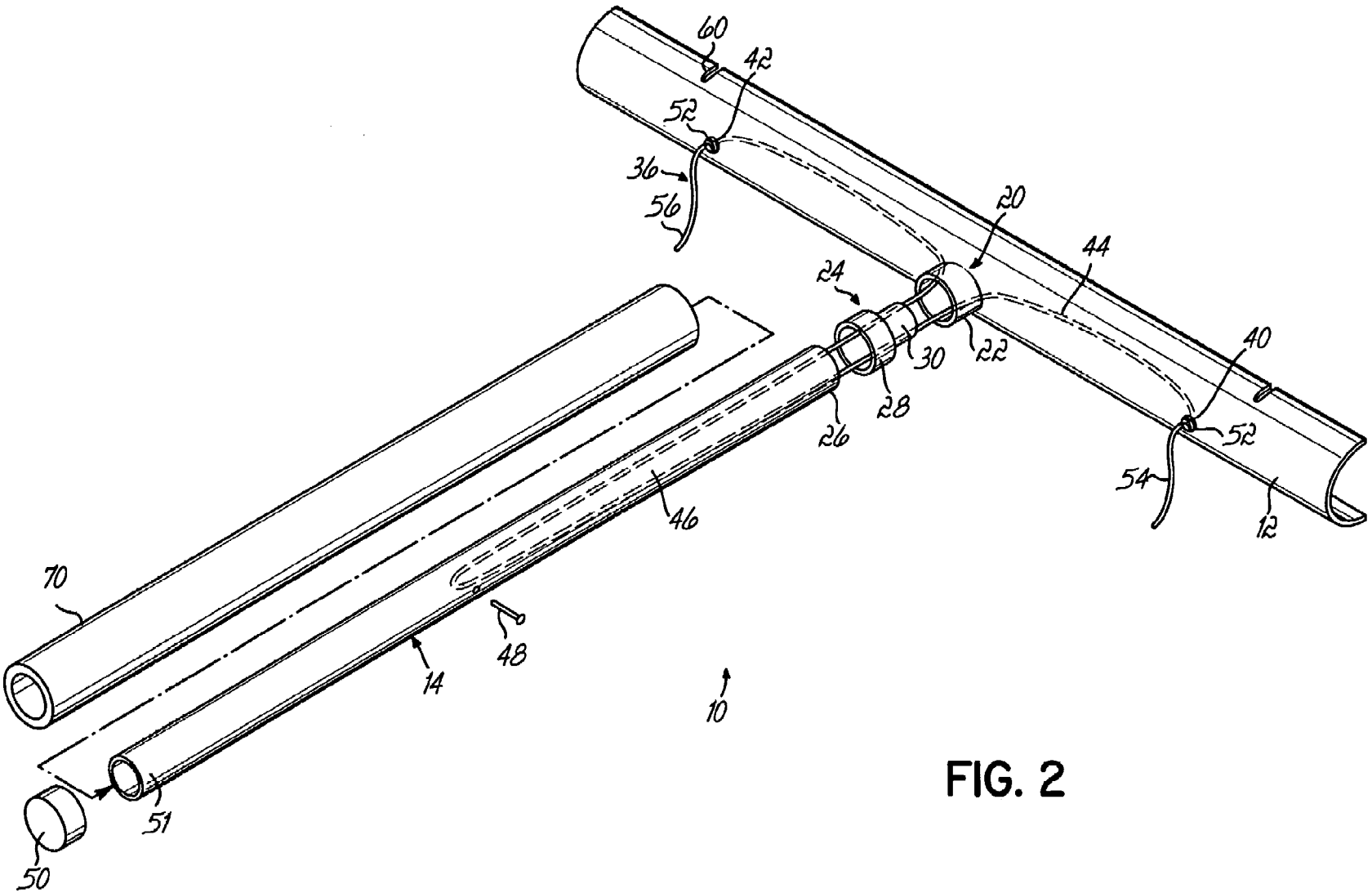
FIG. 2 is a disassembled perspective view of the training device of FIG. 1.

With reference to FIGS. 1 and 2, a training device 10 according to an embodiment of the present invention is shown. The training device 10 generally comprises a base member 12 and an elongated member 14. The base member 12 is shaped to cooperate with at least a portion of a lane guide 16, which may be any suitable lane divider or railing. For example, although the training device 10 is generally designed for use in a swimming pool, it will be appreciated that the present invention may also be used in other environments having lane guides.

The base member 12 further includes a receiving member 20, which is integrally formed with the base member 12 and includes a neck portion 22. A reducer 24 couples the elongated member 14 to the neck portion 22. More specifically, a first end 26 of elongated member 14 is inserted into an end 28 of reducer 24, and a reduced-diameter end 30 of reducer 24 is inserted into the neck portion 22. While the embodiment shown in FIGS. 1 and 2 show the first end 26 of elongated member 14 friction fitted into the end 28 of reducer 24, the reducer 24 may be formed integrally with the first end 26 or may be coupled thereto by threads, bolts, adhesive, or any other fastening means known in the art. The reduced-diameter end 30 of reducer 24 should be sized so that it fits within the neck portion 22 but allows the reducer 24 and thus the elongated member 14 to move relative to the neck portion 22 and base member 12.

In order to couple the elongated member 14 to the base member 12, the training device 10 further comprises a resilient member 36. As will be discussed in greater detail below, the resilient member 36 may be any structure adapted to return the elongated member 14 to an initial position whenever it deviates therefrom. In the embodiment shown in FIGS. 1 and 2, the resilient member 36 is an elastic cord (e.g., a bungee cord). The cord 36 extends through first and second apertures 40, 42 on the base member 12 such that a middle portion 44 of cord 36 is positioned between the first and second apertures 40, 42. More specifically, the middle portion 44 of cord 36 extends from the first and second apertures 40, 42, through the neck portion 22 of receiving member 20, and into a hollow portion 46 of elongated member 14. Within the hollow portion 46, the cord 36 is wrapped around or over a support member 48 positioned within the elongated member 14. The support member 48 may be a pin, bolt, screw, hook, flange, or any other similar structure.

As shown in FIGS. 1 and 2, the elongated member 14 is completely hollow such that the hollow portion 46 is coextensive with the length of the elongated member 14. To this end, the elongated member 14 may be advantageously formed from a readily available section of PVC pipe or the like. The same can be said with respect to the base member 12 and the reducer 24. In order to prevent water from filling the elongated member 14 during use, a cap 50 may be place over a second end 51 of elongated member 14.

Prior to use, the cord 36 may freely extend through the first and second apertures 40, 42 such that the middle portion 44 is not placed under any tension. Alternatively, the cord 36 may be provided with knots 52 or other projections so as to prevent first and second end portions 54, 56 from extending through the respective first and second apertures 40, 42. The knots 52 may be positioned along the cord 36 to provide the middle portion 44 with some slack, or may be positioned such that the length of cord associated with the middle portion 44 is sufficient to place the cord under tension between the first and second apertures 40, 42. Either way, the first and second end portions 54, 56 of cord 36 are readily available for securing the training device 10 to the lane guide 16.

Figure 3:
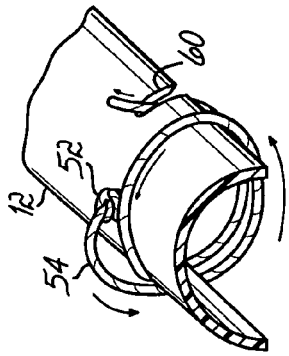
FIG. 3 is an enlarged view of a resilient member securing the training device of FIG. 1 to a portion of a lane guide.

For example, the first and second end portions 54, 56 may simply be tied to the lane guide 16 to secure the base member 12 thereto. As shown in FIGS. 1 and 3, the base member 12 may also be secured to the lane guide 16 by wrapping the first and second end portions 54, 56 around the lane guide 16. One or more slots 60 provided in base member 12 are adapted to receive the first and second end portions 54, 56 and maintain tension in the cord 36. Such an arrangement is particularly advantageous when securing the training device 10 to the lane guide 16 shown in FIG. 1. This type of lane guide is typically comprised of numerous discs 62 spaced along a rope or cable 64. The first and second end portions 54, 56 may be positioned in the spaces between consecutive discs 62 so as to prevent the base member 12 from sliding along the length of the lane guide 16.

Figure 4A:
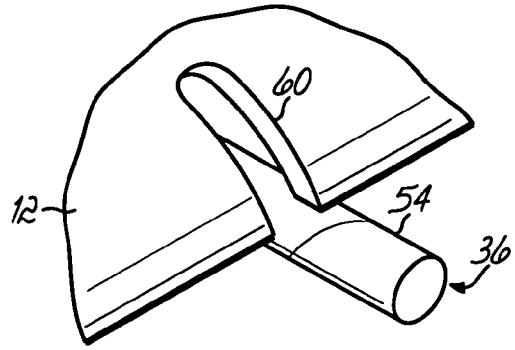
FIGS. 4A through 4C are enlarged views of the resilient member of FIG. 3.
Figure 4B:
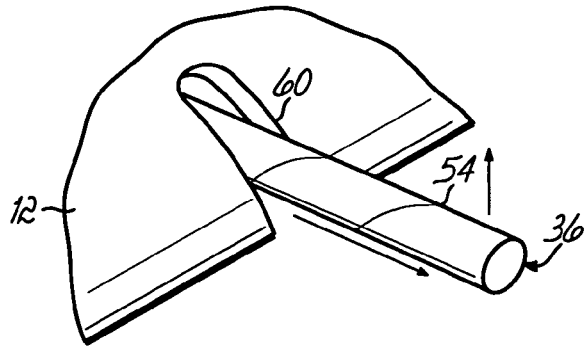
Figure 4C:
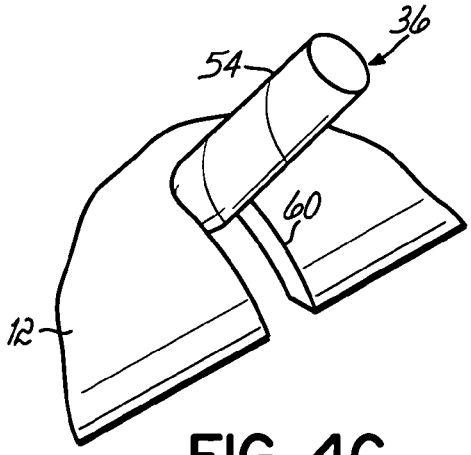

FIGS. 4A through 4C illustrate the slot 60 of base member 12 in further detail. Although only the first end portion 54 of cord 36 is shown with the slot 60, the second end portion 56 of cord 36 may be secured to the base member 12 in a similar manner. As shown in FIG. 4A, the slot 60 has a width less than the normal (unstressed) diameter of the cord 36 such that the slot 60 is not adapted to receive the cord 36. When the cord 36 is pulled, its diameter necks or becomes smaller to allow the cord 36 to be received by the slot 60, as shown in FIG. 4B. When the cord 36 is allowed to relax, its diameter expands and contacts the slot 60. To this end, the slot 60 serves to hold cord 36 in place as shown in FIG. 4C. Even if the cord 36 does not include knots or projections 52, the slots 60 may be used to maintain tension in the middle portion 44 during use.

Once the base member 12 has been secured to the lane guide 16 at a desired location, the training device 10 may be used as a target or marker within the pool. For example, the elongated member 14 may represent the minimum distance at which a swimmer should surface above the water after pushing off from the pool wall during a flip-turn. The swimmer will realize whether he or she has surfaced too early by virtue of contacting the elongated member 14. When such contact occurs, the elongated member 14 is able to pivot relative to the base member 12 in order to prevent injury to the swimmer and allow him or her to continue swimming forward. A protective member 70 may also be placed around the elongated member in order to further reduce the potential for injury. The protective member 70 may be formed from any material that helps reduce the impact associated with contacting the elongated member 14, such as foam padding or other cushioning material.

Figure 5:
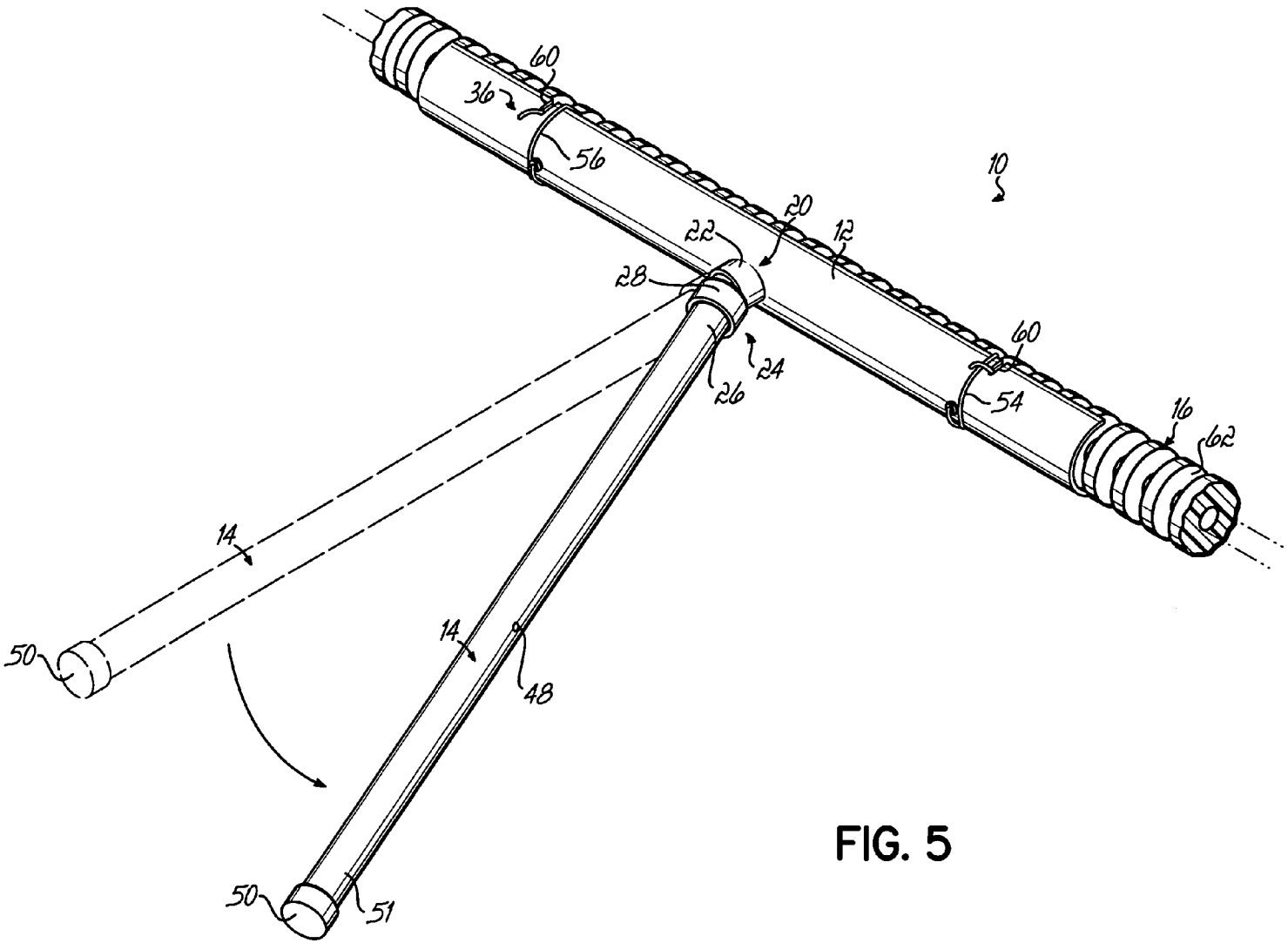
FIG. 5 is a perspective view of the training device of FIG. 1 with an elongated member deflected from an initial position.

FIG. 5 illustrates the pivotal movement of the elongated member 14 in further detail. Specifically, the elongated member 14 is able to pivot relative to the base member 12 because the reduced-diameter end 30 of reducer 24 has a diameter smaller than the neck portion 22 to provide the reducer 24 with sufficient freedom of movement relative to the neck portion 22. When the swimmer is no longer in contact with the training device 10, the tension in the resilient member 36 causes the elongated member 14 to return to its initial position, which for most applications is substantially perpendicular to the lane guide 16. In other words, the training device 10 automatically "resets" itself such that the elongated member 14 returns to the initial position for the next swimmer. Applicant has found that eventually most swimmers will make the necessary adjustments in order to avoid contact with the elongated member 14. Thus, the present invention enables swimmers to develop proper turning and starting techniques without the use of expensive and complex visualization equipment.

Figure 6:
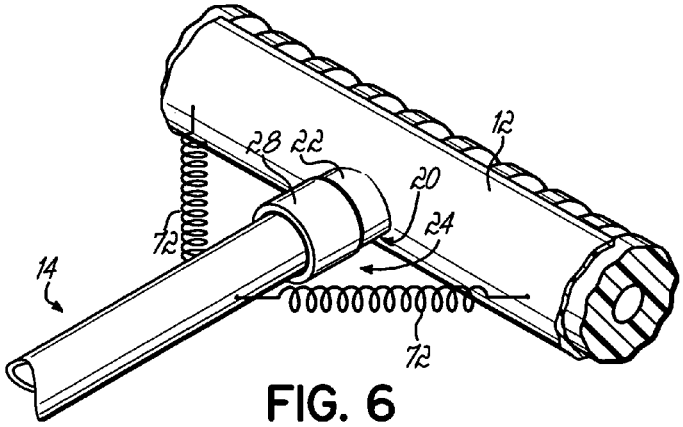
FIG. 6 is perspective view showing an alternative embodiment of the resilient member.
Figure 7:
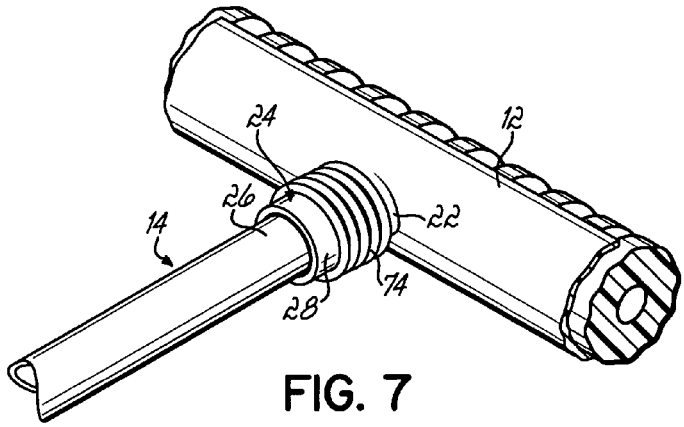
FIG. 7 is a perspective view showing a further embodiment of the resilient member.

Although the figures illustrate the resilient member 36 as an elastic cord, it will be appreciated that the present invention encompasses any general resilient member suited to return the elongated member 14 to an initial position. For example, FIG. 6 shows an alternative embodiment in which the resilient member comprises one or more springs 72 that couple the elongated member 14 to the base member 12. The springs 72 may be attached to the exterior of the base member 12 and elongated member 14 as shown, or may extend behind the base member 12 and into the hollow portion 46 much like the elastic cord 36. The opposite can be said with respect to the cord 36. In other words, the cord 36 may alternatively be coupled to the exterior of the elongated member 14 much like the springs 72. FIG. 7 shows a further embodiment in which the resilient member comprises a coil spring 74. The coil spring 74 is wrapped around both the reducer 24 and the neck portion 22 so as to couple the elongated member 14 to the base member 12. Although the coil spring 74 can bend or flex in order to allow the elongated member 14 to pivot relative to the base member 12, its resilient nature causes the elongated member 14 to return to an initial position.

Figure 8:
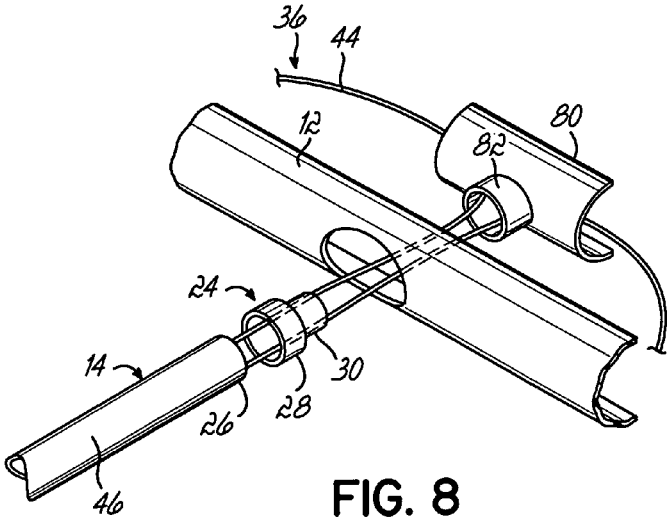
FIG. 8 is a disassembled view, partially cut-away, of a training device according to an alternative embodiment of the present invention.

FIG. 8 shows an alternate arrangement for coupling the elongated member 14 to the base member 12. In this arrangement, an intermediate member 80 is positioned between the base member 12 and the lane guide 16. The intermediate member 80 has a neck portion 82 that extends through an aperture 84 in the base member 12. Thus, the intermediate member 80 generally has a T-shaped configuration and may be formed by modifying a standard PVC pipe fitting or the like. The neck portion 82 of intermediate member 80 is adapted to pivotally engage the reducer 24 and first end 26 of elongated member 14, much like the neck portion 22 shown in FIGS. 1 and 2. This particular arrangement operates under the same general principles that were discussed in connection with the embodiment shown in FIGS. 1 and 2.

Figure 9:
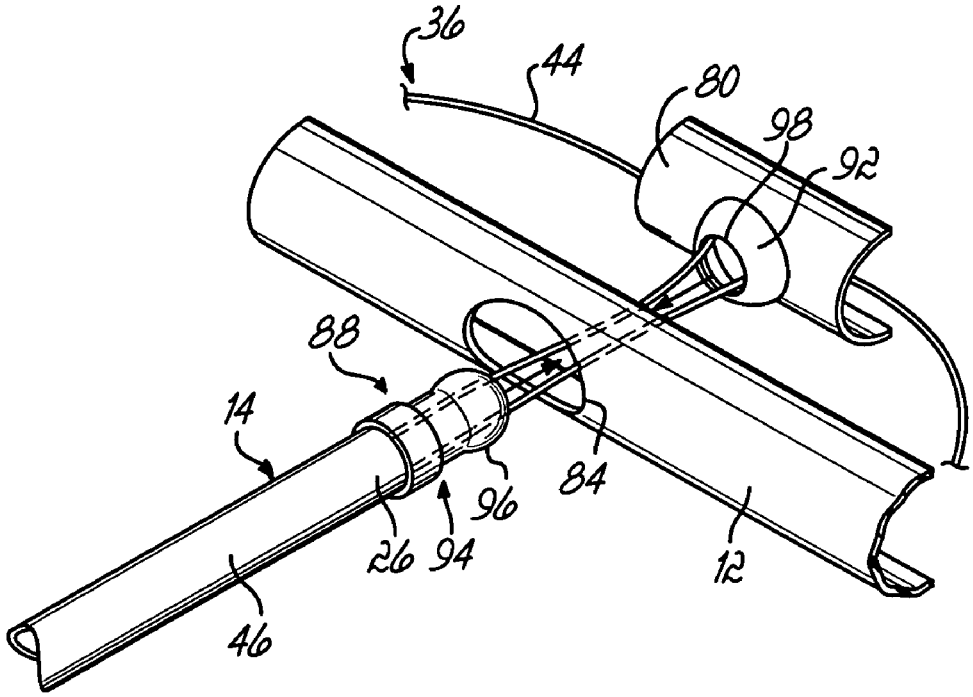
FIG. 9 is a disassembled view, partially cut-away, of a training device according to a further embodiment of the present invention.

FIG. 9 shows another arrangement for coupling the elongated member 14 to the base member 12. Rather than including a reducer 24 and neck portion 22 to facilitate pivotal movement of the elongated member 14, the training device includes a ball and socket arrangement 88. More specifically, an intermediate member 90 has a socket 92 that extends through the aperture 84 on base member 12. A ball joint 94 coupled to the first end 26 of elongated member 14 has a base portion 96 with a diameter greater than that of the elongated member 14. Because the base portion 96 also has a diameter greater than an opening 98 on the socket 92, the ball joint 94 may be inserted through the opening 98 until the base portion 96 pivotally engages the socket 92. Such an arrangement enables the elongated member 14 to pivot relative to the base member 12.

The ball joint 94 is hollow in order to allow the resilient member 36 to extend therethrough before entering the hollow portion 46 of elongated member 14 and wrapping over the support member 48. Otherwise, this arrangement operates under the same general principles that were discussed in connection with the embodiment shown in FIGS. 1 and 2. Also note that the socket 92 could be integrally formed with the base member 12, similar to the neck portion 22 shown in FIGS. 1 and 2.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A training device for use in a pool having a swimming lane guide, the training device comprising:

a base member having a receiving member, the base member having an enlongated portion that is curved in shape to cooperate with at least a portion of a swimming lane guide;

an elongated member having a first end pivotable coupled with the receiving member such that the elongated member pivots relative to the base member; and a resilient member coupling the elongated member to the base member in an initial position wherein the elongated member is perpendicular to the elongated portion of the base member, the resilient member is adapted to return the elongated member to the initial position when the elongated member is deviated therefrom, the base member further includes first and second apertures positioned on opposite sides of the receiving member and the resilient member extends through both the first and second apertures.

2. The training device of claim 1, wherein the base member includes at least one slot adapted to receive the resilient member after it extends through the first and second apertures and around the lane guide thereby securing the base member to the lane guide.

3. The training device of claim 1, wherein the elongated member includes a hollow portion extending from the first end and further includes a support member positioned in the hollow portion, the resilient member entering into the hollow portion, wrapping over the support member, and exiting the hollow portion.

4. The training device of claim 1, wherein the receiving member has a neck portion adapted to operatively receive the first end of the elongated member.

5. The training device of claim 4, further comprising:

a reducer coupled to the first end of the elongated member, the reducer having a narrow portion to facilitate engaging the elongated member to the neck portion of the receiving member.

6. The training device of claim 5, wherein the reducer is formed integrally with the elongated member.

7. The training device of claim 4, wherein the neck portion of the receiving member includes a socket and the first end of the elongated member includes a ball joint adapted to pivotally engage the socket.

8. The training device of claim 1, further comprising:

a protective member adapted to be placed around at least a portion of the elongated member.

9. A training device for use in a pool having a swimming lane guide, the training device comprising:

a base member having a first aperture, the base member having an elongated portion that is curved in shape to cooperate with at least a portion of a swimming lane guide;

an intermediate member positioned between the base member and the swimming lane guide, the intermediate member having a neck portion extending through the first aperture of the base member;

an elongated member having a first end pivotally engaging the neck portion of the intermediate member; and a resilient member coupling the elongated member to the base member in an initial position wherein the elongated member is perpendicular to the elongated portion of the base member, the resilient member is adapted to return the elongated member to the initial position when the elongated member is deviated therefrom, the base member further includes second and third apertures positioned on opposite sides of the first aperture and the resilient member extends through both the second and third apertures.

10. The training device of claim 9, further comprising:

a reducer coupled to the first end of the elongated member, the reducer having a narrow portion to facilitate engaging the elongated member to the neck portion of the intermediate member.

11. The training device of claim 10, wherein the reducer is formed integrally with the elongated member.

12. The training device of claim 9, wherein the intermediate member is formed integrally with the base member.

13. The training device of claim 9, wherein the base member includes at least one slot adapted to receive the resilient member after it extends through the second and third apertures and around the lane guide thereby securing the base member to the lane guide.

14. A training device for use in a pool having a swimming lane guide, the training device comprising:

a base member having a first aperture, the base member having an elongated portion that is curved in shape to cooperate with at least a portion of a swimming lane guide;

an intermediate member positioned between the base member and the swimming lane guide, the intermediate member having a socket extending through the first aperture of the base member;

an elongated member having a first end with a ball joint, the ball joint pivotally engaging the socket; and a resilient member coupling the elongated member to the base member in an initial position wherein the elongated member is perpendicular to the elongated portion of the base member, the resilient member is adapted to return the elongated member to the initial position when the elongated member is deviated therefrom, the base member further includes second and third apertures positioned on opposite sides of the first aperture and the resilient member extends through both the second and third apertures.

15. The training device of claim 14, wherein the intermediate member is formed integrally with the base member.

16. The training device of claim 14, wherein the base member includes at least one slot adapted to receive the resilient member after it extends through the second and third apertures and around the lane guide thereby securing the base member to the lane guide.

* * * * *

UNITED STATES PATENT AND TRADEMARK OFFICE

CERTIFICATE OF CORRECTION

PATENT NO. : 7,335,136 B2
APPLICATION NO. : 11/185453
DATED : February 26, 2008
INVENTOR(S) : Ralph R. Brodbeck It is certified that error appears in the above-identified patent and that said Letters Patent is hereby corrected as shown below:

Column 5, Line 65, “pivotable” should read -- pivotably --.

Signed and Sealed this

Thirtieth Day of September, 2008

JON W. DUDAS
*Director of the United States Patent and Trademark Office*